US007755498B2

(12) United States Patent
McCoy

(10) Patent No.: US 7,755,498 B2
(45) Date of Patent: Jul. 13, 2010

(54) DISCRETE LEAK DETECTION DEVICE AND METHOD FOR DISCRIMINATING THE TARGET FLUID

(75) Inventor: Kenneth McCoy, Redwood City, CA (US)

(73) Assignee: Tyco Thermal Controls LLC, Menlo Park, CA (US)

( * ) Notice: Subject to any disclaimer, the term of this patent is extended or adjusted under 35 U.S.C. 154(b) by 247 days.

(21) Appl. No.: 11/837,186

(22) Filed: Aug. 10, 2007

(65) Prior Publication Data

US 2008/0100462 A1 May 1, 2008

(51) Int. Cl.
*G08B 21/00* (2006.01)

(52) U.S. Cl. ..... 340/605; 73/40

(58) Field of Classification Search ..... 340/604, 340/605, 540, 603; 73/40; 174/11 R
See application file for complete search history.

(56) References Cited

U.S. PATENT DOCUMENTS

| | | | | |
|---|---|---|---|---|
| 4,740,777 | A * | 4/1988 | Slocum et al. | 340/522 |
| 5,187,366 | A * | 2/1993 | Hopenfeld | 250/302 |
| 5,235,286 | A | 8/1993 | Masia | |
| 5,341,128 | A * | 8/1994 | Keyser et al. | 340/605 |
| 6,777,947 | B2 | 8/2004 | McCoy | |

* cited by examiner

*Primary Examiner*—Jeffery Hofsass

(57) ABSTRACT

A device and method for detecting the presence of one or more targeted liquids in volume of space where the targeted liquid is not normally present. The device includes a sensor that can differentiate between the target fluid and a non-target fluid.

18 Claims, 4 Drawing Sheets

Cross section view of initial embodiment:

Cross section view of initial embodiment:

DISCRETE LEAK DETECTION DEVICE AND METHOD FOR DISCRIMINATING THE TARGET FLUID

This invention includes a device and method for detecting the presence of one or more targeted liquids in volume of space where the targeted liquid is not normally present.

BACKGROUND OF THE INVENTION

Transporting liquids such as crude oil, refined petroleum products, or corrosive liquids such as concentrated acids or bases is often accomplished utilizing tanks and underground pipelines. Underground pipelines are subject to leakage from the piping, fittings, and valves. When an underground pipe carrying a hazardous or corrosive liquid develops a leak, the leak must first be detected and located before it can be repaired.

Various systems for detecting leaks are well-known. For example, sensor cables may be used to detect changes in variables along an elongate path, such as the presence of a liquid such as water, an organic solvent, or a corrosive liquid. Sensor cables may be extended in a pipeline, along the length or longitudinal axis or at various sections or points at which the leakage of liquids tends to occur. Additionally, crude oil leak detection over the many thousands of miles of an oil pipe transport system is extremely difficult to perform. However, detecting low rate leaks caused by corrosion of the carrier pipe (inner pipe) is increasingly important to the oil companies and governmental agencies, such as the State of Alaska, as the piping system ages.

Accordingly, there is a need in the field of transporting liquids for improvements in leak detection. The present invention addresses this and other needs.

BRIEF SUMMARY OF THE INVENTION

The present invention includes a fluid detection device having an attachment means for fixing the device to a surface, the attachment means forming a passage thought the surface, a discriminating sensor device effective to differentiate between a target fluid and a non-targeted fluid, a source of power and an indicator for indicating the presence of the target fluid.

DETAILED DESCRIPTION OF THE PREFERRED EMBODIMENT

The invention preferably includes a device having an attachment means or device, a discriminating sensor device that can differentiate between the target fluid and a non-targeted fluid (e.g., water), a source of power; and an indicator. The invention may further include a method using the above-described device where the method assures that the targeted fluid will come into contact with the sensor device.

Figure 1A:
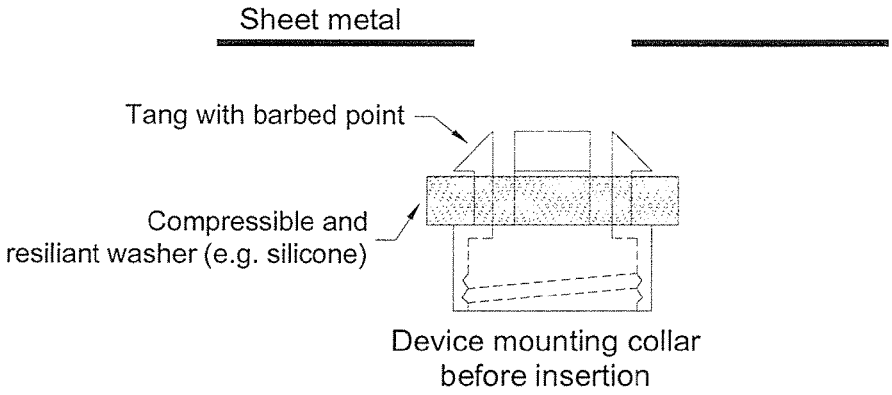
FIGS. 1A-1D illustrate a preferred embodiment of the invention.
Figure 1B:
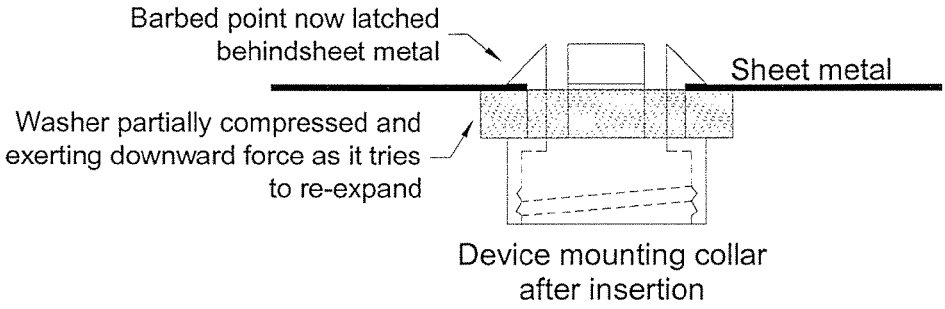

One preferred embodiment of the invention is shown in FIGS. 1A-1D. As seen in FIGS. 1A and 1B, the device includes an attachment having two or more tangs with barbed points, and a soft compressible and resilient washer. The device is attached to and placed though a surface in a two part operation using a mounting collar and the body of the device. This method is especially suited to attaching the device to a thin layer of material as for instance sheet metal. The sheet metal may have a soft or deformable insulation material on the surface of the sheet metal opposite the device. To use this method of attachment, the installer will drill a hole of the appropriate diameter through the sheet metal. The device is then installed by pushing the tang end of the device through the hole such that the barbs extend beyond the edge of the sheet metal and latch the device into place. The thick washer of a soft but resilient material, closed cell silicone foam for instance, is fitted to the device so that during the installation, the washer is compressed between the surface of the sheet metal and the body of the mounting collar. After the barbs latch behind the inner surface of the sheet metal, the tendency of the deformed washer to re-expand serves to pull back against the barbs and insure a snug fit at a predictable depth.

Figure 1C:
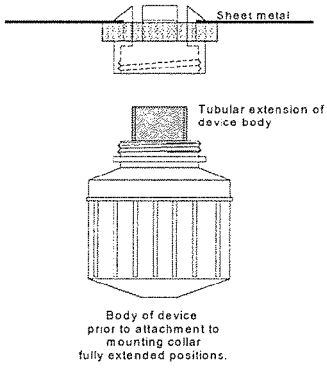
Figure 1D:
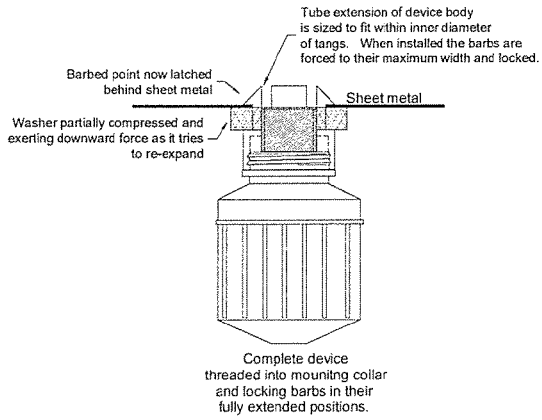

Referring to FIGS. 1C and 1D, the body of the device can next be threaded into the threads at the bottom of the mounting collar. A tubular extension of the sensor chamber can be sized such that with the body of the device in place, the barbs are completely extended in a radial direction and locked into place and are incapable of bending inward. This feature assures a positive locking mechanism and allows substantial weight to be suspended up to the breaking point of barbs, tangs or yield strength of the sheet metal. This feature is particularly helpful if the area above the sheet metal is filled with a semi-rigid, but deformable, foam insulation such as polyurethane.

Figure 2A:
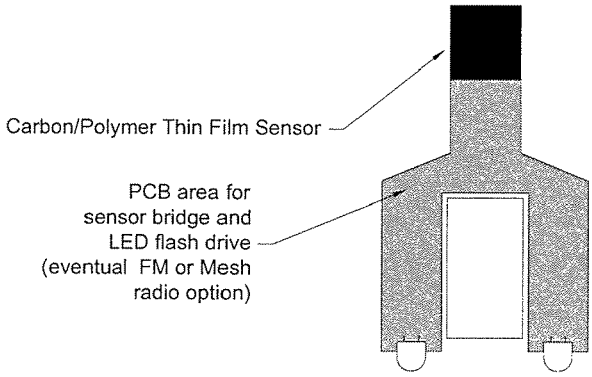
FIGS. 2A-2B illustrate examples of sensors components of the invention.
Figure 2B:
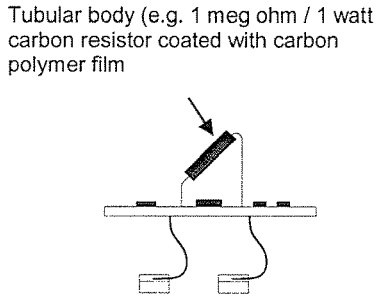

Referring to FIGS. 2A and 2B, the sensor device (shown in FIG. 2A) is fabricated at the end of a printed circuit board. The sensor element has a film of material that changes resistance in the presence of the targeted fluid. In this embodiment, the film is a thin layer of carbon particles suspended in a polymer binder such that the carbon particles make contact with each other and produce a lower resistivity when the target fluid is not present. When the target fluid is present the polymer binder material can be formulated to swell, thereby reducing the quantity of carbon particles touching each other and secondarily causing a dramatic change in resistivity through the film. Other geometries of carbon/polymer films are determinable by one skilled in the art, such as the deposition of the carbon/polymer film on the exterior surface of a tubular, leaded component such as for instance a 1 watt carbon resistor, shown in FIG. 2B.

In both of these embodiments and similar embodiments, the sensor device can be constructed and assembled into the body of the device such that the sensor element extends up to and within the tubular extension of the device. It is possible to seal the lower portion of the tubular extension, for instance with epoxy potting compound, such that a chamber closed on the bottom but open on the top is formed. In the initial embodiment, with the device attached to the bottom side of a pre-insulated crude oil pipeline, a drip chamber is formed such that any oil leaking from the primary pipe and flowing along the inside of the insulation's sheet metal cladding, will drip into the tubular extension of the device and into direct contact with the sensor element.

The sensor technology sited in this preferred device has the special property of discriminating between a fluid of interest, as for example crude oil, and water. It is important to ignore water since water can frequently be present due to condensation or imperfect sealing of the insulation cladding or lagging.

An additional aspect of the invention utilizes other discriminating sensors in other double wall pipe or double bottom tank systems where a targeted fluid should be detected but water should be ignored. An example of another discriminating sensor is the acid sensor disclosed in U.S. Pat. No. 6,777,947, by McCoy et. al., entitled "Sensor Cable", issued Aug. 17, 2004. In this example the targeted fluid would be concentrated acid. The outer wall of a typical double wall hazardous fluid pipe system would provide the mechanism to convey any leak to the body of the device. The means of attachment and the use of the tubular extension acting as a drip chamber would be identical.

Figure 3:
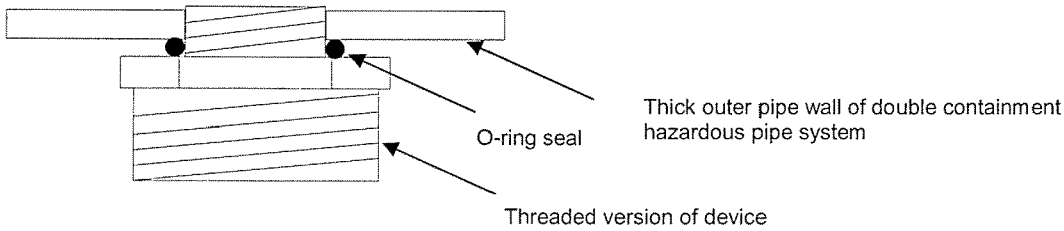
FIG. 3 illustrates an attachment mechanism for the invention.

The means of attachment is not limited to the tang, barb and locking mechanism as described above. For example, in situations where the wall thickness of the containment pipe or exterior tank bottom is sufficiently thick, a threaded mechanism may prove equally effective. Such an arrangement is shown in FIG. 3.

The invention preferably includes a power supply. Representative power supplies include batteries of sufficient shelf life and charge storage capacity as an ideal means of powering a self contained version of the device. As an example, the 19 amp-hour, 3.6 VDC Lithium Thyonil D-cell, Model TL-5930 manufactured by Tadrian Lithium Batteries has excellent shelf life characteristics and high energy density. Using the carbon/polymer thin film sensor technology the resistance of the sensor film can be monitored with an extremely low current such that the standby life of the self-contained device is projected to be in excess of 5 years. If and when the polymer film is contacted by a target fluid, such as crude oil, the remaining residual battery power can be utilized to activate one or several enunciation devices. The initial embodiment of the device is sized to enclose the thin film sensor device, circuit board space for the components for monitoring the resistance of the sensor, and one or more simple enunciation devices.

The indicator or method of enunciation of the invention indicates that a targeted fluid has been detected. In one embodiment of the device, the method of enunciation includes high brightness, high efficiency LEDs. As seen in FIGS. 1C and 1D, the lower cover of the enclosure system is fabricated from a clear polymer material so that the LEDs can be seen through the clear cover. The circuitry of the device can be easily made to intermittently flash the LEDs when the resistance of the sensor film exceeds a pre-set threshold. In this embodiment, "no flashing" indicates that no target fluid has contacted the device, while flashing LEDs indicate that the target fluid has contacted the sensor portion of the device. Very low duty cycle pulsing can be effective as enunciation and is very conservative of battery power. For instance a flash lasting 50 milliseconds emitted once every second, can be easily detected by a near-by observer while consuming only 5% of the energy required to operate the LEDs continuously.

Other examples of battery powered enunciation devices include low power FM transmitter or a radio frequency node of a mesh network.

Figure 4A:
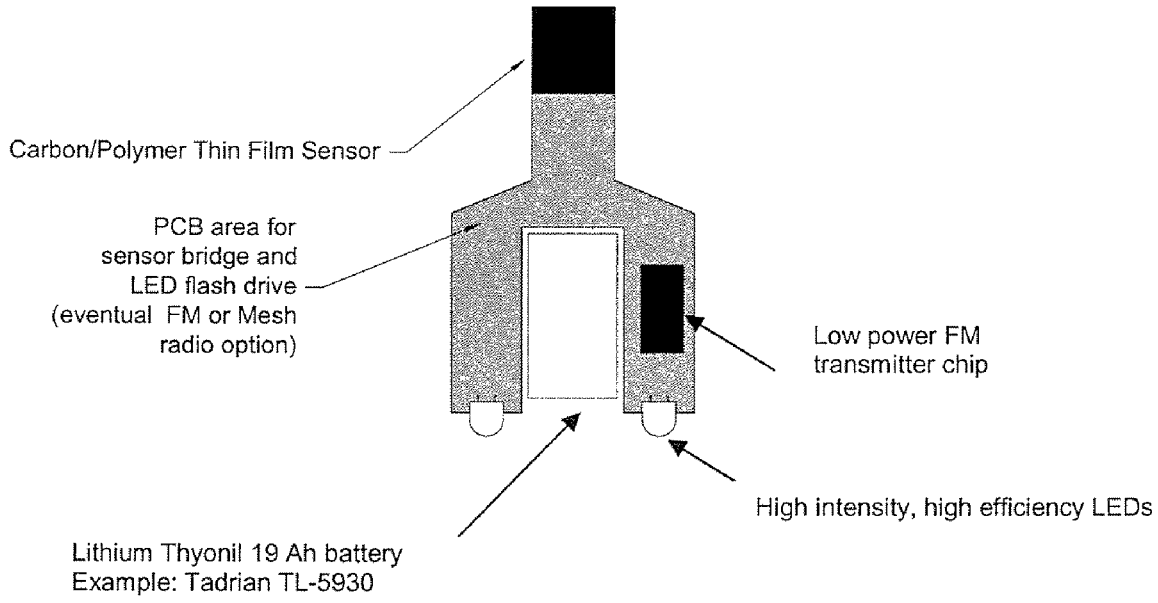
FIGS. 4A-4B illustrate simple dual mode enunciation systems of the invention; and, FIGS. 5A-5B illustrate the invention having the power and enunciation functions performed remotely.
Figure 4B:
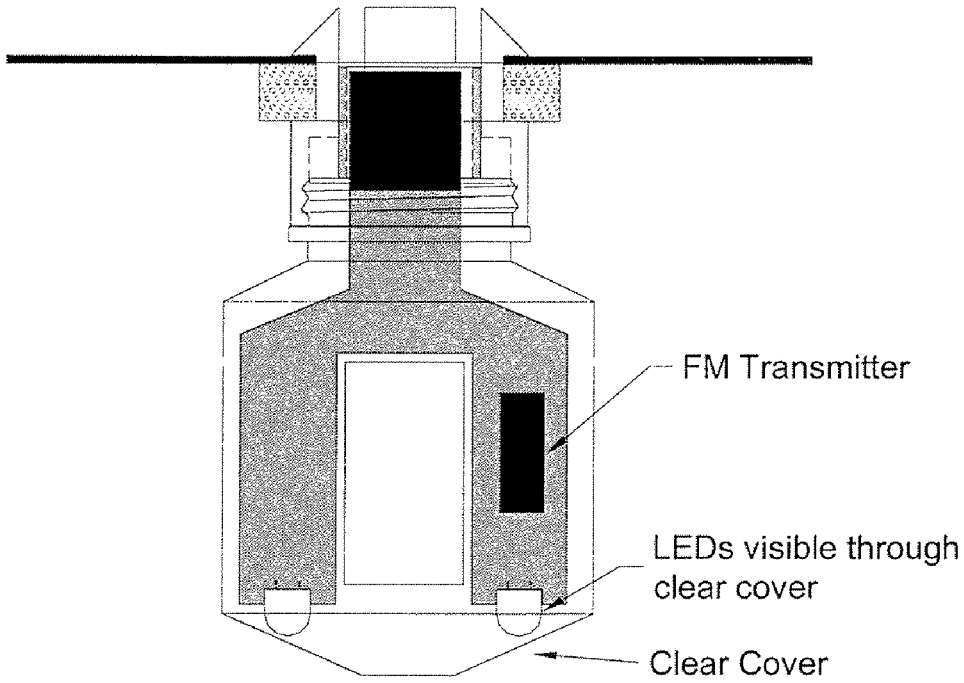

As seen in FIGS. 4A and 4B, an example of a simple dual mode enunciation system is illustrated. The device is shown to be made to flash the LEDs and transmit a low power FM signal. In this example a maintenance worker driving along a service road would be able to see a flashing indication if the device has detected a leak. Using a vehicle mounted FM radio receiver, the worker would be able to hear a tone or a pulsed signal when in the vicinity of a device that had detected the target fluid.

Initial analysis of the circuitry necessary to monitor the sensor film, flash the LEDs and emit an FM signal indicates that the battery capacity may be sufficient for an enunciation lasting in excess of 30 days from initial detection of the targeted fluid when the TL-5930 battery is used.

Figure 5A:
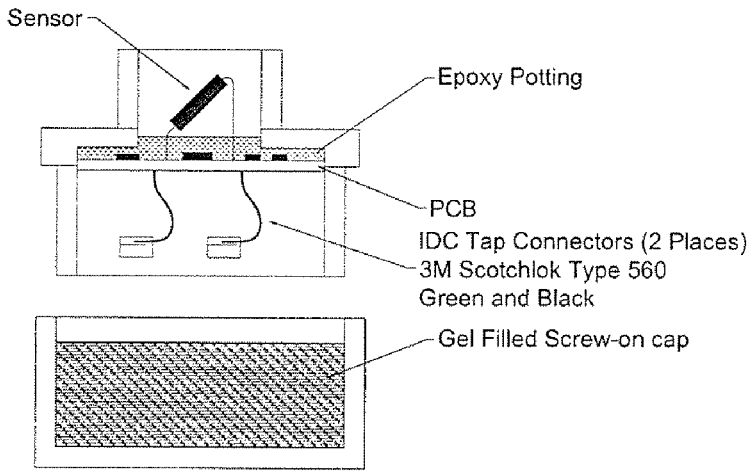
Figure 5B:
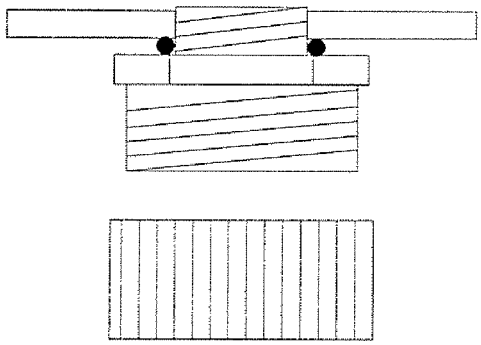
Figure 5C:
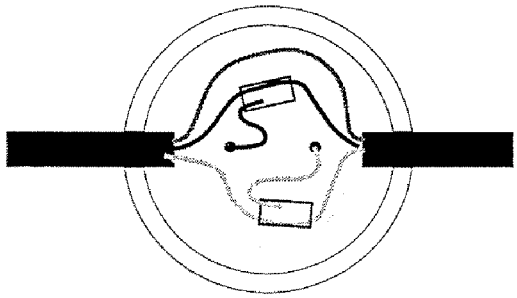

As seen in FIGS. 5A, 5B and 5C, this embodiment of the invention has the power and enunciation functions performed through a direct wire connection to control room equipment. The output of the sensor circuit may easily be configured to close a solid state switch (e.g., a transistor) when the target fluid is detected. A switch closure can be detected and located along a four wire circuit in the method taught by U.S. Pat. No. 5,235,286, to Masia et. al., entitled "Method for Detecting and Obtaining Information about Changers in Variables", issued Aug. 10, 1993.

A device of this type is useful when physical inspection is not easily achieved. Representative uses of the invention include monitoring pipeline systems preferably having a multiple wall system (e.g., having an inner pipe with an outer protective layer). These systems are commonly found in above ground pre-insulated pipes such as oil piping systems found on the north slope of Alaska having a steel pipe interior within a polyurethane foam filled shell. The control room device, for example, Tyco Thermal Controls device TT-SIM can be simply modified to produce sufficient current to power in excess of 100 detection devices. The circuit embodied in the TT-SIM can also locate which device along the string of 100 or more devices made the detection and can report the distance from the control room to the detection device in terms of feet or meters.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A fluid detection device, comprising:

an attachment means for fixing the device to a surface, the attachment means forming a passage through the surface;

the attachment means including a washer component and tang with barbed points wherein the tang inserts within an opening on the surface;

a discriminating sensor device effective to differentiate between a target fluid and a non-targeted fluid;

a source of power; and an indicator for indicating the presence of the target fluid.

2. The fluid detection device of claim 1, wherein the discriminating sensor device includes a film of material that changes resistance in the presence of a targeted fluid effective to differentiate between a target fluid and a non-targeted fluid.

3. The fluid detection device of claim 1 further comprising a sensor chamber.

4. The fluid detection device of claim 3, wherein sensor chamber includes a mounting collar.

5. The fluid detection device of claim 3, wherein the sensor chamber includes a tubular extension.

6. The fluid detection device of claim 1, wherein the sensor chamber includes a drip chamber.

7. The fluid detection device of claim 1, wherein the target fluid is crude oil.

8. The fluid detection device of claim 1 wherein the discriminating sensor device includes an acid sensor.

9. The fluid detection device of claim 1, wherein the power supply is batteries.

10. The fluid detection device of claim 9, wherein the batteries are lithium batteries.

11. The fluid detection device of claim 1, wherein the indicator is selected from the group consisting of LEDs, FM transmitter, radio frequency node of a mesh network, and combinations thereof.

12. The fluid detection device of claim 11, wherein the indicator is a combination of LEDs and FM transmitter.

13. A method of differentiating between a target fluid and a non-target fluid, comprising the steps of:

providing a fluid detection device having an attachment means for fixing the device to a surface, the attachment means including a washer component and tang with barbed points wherein the tang inserts within an opening on the surface, a discriminating sensor device effective to differentiate between a target fluid and a non-targeted fluid, a source of power, and an indicator for indicating the presence of the target fluid;

fixing the fluid detection device to a pipe, wherein the attachment means forms a passage through the surface of the cladding on an insulated pipe; and, indicating the presence of a target fluid when the target fluid contacts the discriminating sensor device.

14. The method of claim 13, wherein the non-target fluid is water.

15. The method of claim 13, wherein contact of the discriminating sensor device by the target fluid causes a solid state switch to close.

16. The method of claim 13, further comprising the step of detaching the discriminating sensor device from the attachment means and replacing the discriminating sensor device.

17. The method of claim 13, wherein the step of fixing the fluid detection device to a pipe fixes the fluid detection device on the bottom part of a pipe.

18. The fluid detection device of claim 1, wherein the tang with barbed points includes at least two tangs.

* * * * *